US007063015B2

(12) United States Patent
Wieland

(10) Patent No.: US 7,063,015 B2
(45) Date of Patent: Jun. 20, 2006

(54) SHEET SUPPORT FOR PRINTING PRESS

(75) Inventor: Rainer Wieland, Würzburg (DE)

(73) Assignee: KBA-Metronic AG, Veitshochheim (DE)

( * ) Notice: Subject to any disclaimer, the term of this patent is extended or adjusted under 35 U.S.C. 154(b) by 34 days.

(21) Appl. No.: 10/912,744

(22) Filed: Jul. 30, 2004

(65) Prior Publication Data

US 2005/0063762 A1 Mar. 24, 2005

(30) Foreign Application Priority Data

Jul. 31, 2003 (DE) ..... 103 35 534

(51) Int. Cl.
*B41F 13/24* (2006.01)

(52) U.S. Cl. ..... 101/232; 101/480; 271/240; 271/253

(58) Field of Classification Search ..... 101/480, 101/232; 400/642; 271/240, 253, 250
See application file for complete search history.

(56) References Cited

U.S. PATENT DOCUMENTS 3,227,443 A 1/1966 Pasquinelli
3,248,106 A * 4/1966 Fry ..... 271/251
4,844,441 A 7/1989 Motohashi
5,087,028 A * 2/1992 Frohlich ..... 271/273
5,209,467 A * 5/1993 Schmaling ..... 271/240
5,259,309 A * 11/1993 Stiel et al. ..... 101/232
5,299,799 A * 4/1994 Filsinger et al. ..... 271/250
5,370,048 A 12/1994 Pietsch

FOREIGN PATENT DOCUMENTS

DE 42 11 927 A1 10/1993
DE 44 28 527 C1 11/1995
DE 10302278 A1 8/2003
EP 0 268 693 A1 6/1988
EP 0 268 693 B1 6/1988

* cited by examiner

*Primary Examiner*—Andrew H. Hirshfeld
*Assistant Examiner*—Marissa Ferguson-Samreth
(74) *Attorney, Agent, or Firm*—Andrew Wilford

(57) ABSTRACT

A sheet support bridging a pair of parallel longitudinally extending and transversely spaced guides has a stack of substantially identical and transversely extending support elements having transversely opposite ends slidable along the guides and a flexible connecting strand engaging all of the elements such that when stressed longitudinally the elements separate longitudinally from one another at a generally uniform spacing.

10 Claims, 7 Drawing Sheets

SHEET SUPPORT FOR PRINTING PRESS

FIELD OF THE INVENTION

The present invention relates to a sheet support. More particularly this invention concerns a support arranged between the downstream end of a sheet conveyor and a printing press.

BACKGROUND OF THE INVENTION

A sheet support for bridging the gap between a sheet conveyor and a printing press has at least one guide bar extending at a right angle to the transport direction of the sheet conveyor, at least one movable and adjustable stop for paper sheets, and a plurality of individual, movable support elements that bridge the gap between the downstream end of the conveyor and the printing press. When sheet format or size changes, this gap size changes also so that the sheet support must be variable in width.

A sheet support of this type is, for example, known from U.S. Pat. No. 5,370,048 of Pietsch. This document discloses a sheet support with two parallel traverses extending perpendicular to the conveyor and on which a plurality of guide bridges are supported. On at least one side surface, these guide bridges have springs which abut adjacent guide bridges. If a lateral stop for guiding a sheet is shifted to a larger width in this sheet support device, the individual guide bridges are pushed apart by the springs, so that the ditch or gap between the printing press and the conveyor is completely covered. Alternately, if the stop is shifted to a smaller width, the guide bridges are pushed together against the spring action of the springs. Since the springs on the guide bridges build up in thickness and an elastic limit of the springs may not be exceeded when they are pushed together, the adjusting path of the known sheet support between maximum and minimum width is only slight.

A similar sheet support is also known from EP 0268 693 in which the individual support elements are formed from thin deformable sheet metal in a U- or V-shape. The sides of adjacent support elements bear elastically on one another. Thus, the elements themselves also form the springs. In this design the elastic limit of the support elements must not be exceeded when pushed together, so that the range of adjustment is also slight.

OBJECTS OF THE INVENTION

It is therefore an object of the present invention to provide an improved sheet support.

Another object is the provision of such an improved sheet support which overcomes the above-given disadvantages, that is which is of simple an economical construction, which can be expanded to a relatively long length and compressed to a very short length, and which can be counted on to have a long service life.

SUMMARY OF THE INVENTION

A sheet support bridging a pair of parallel longitudinally extending and transversely spaced guides has according to the invention a stack of substantially identical and transversely extending support elements having transversely opposite ends slidable along the guides and a flexible connecting strand engaging all of the elements such that when stressed longitudinally the elements separate longitudinally from one another at a generally uniform spacing. The strand is normally attached at its end to end blocks of which one can also form a paper stop.

In the sheet support according to the invention, at least one end block forms a stop and a plurality of support elements are guided in a movable manner on or by means of at least one guide bar perpendicular to the direction of conveyance of a sheet in order to accommodate different stops for sheets, with the movable end block and to cover the gap between a printing press and a conveyor for feeding supporting the sheets.

An essential advantage of the invention is that the individual support elements and the end blocks are interconnected by at least one connecting element, in particular, fastened to one another. The connecting element or elements are constructed and/or arranged in such a way that the individual support elements can be pushed against one another by means of one or two opposite end blocks. Due to there being no springs between the individual support elements, in an ideal case they can be pushed together until they are in direct contact. As a result, the minimum adjustable width of the sheet support can be clearly reduced in comparison to the prior art.

When the end block or elements are set to a larger width, according to the invention a tractive force is exerted on one or more support elements by at least one end block when it is shifted by the at least one connecting element, so that said support elements follow, in particular, successively the movement of an end block.

Going further it can for example be provided that a maximum distance between adjacent support elements or between an end block and a support element is defined by at least one connecting element. In particular, this is attained when a connecting element cannot be extended beyond a maximum length but is compressible when the support elements are pushed together. For example, a connecting element of this type can be flexible, yet fundamentally inelastic or nonextensile with respect to its maximum length. A connecting element of this type can also be telescopic.

A preferred connecting element can for example be a belt, a strand, or a wire that extends in the direction of movement of the support elements between at least one of the side elements and the opposite sides of the bridge. Thus each support element is fixed at the connecting element.

The strand is preferably secured at uniform spacings along its length to the support elements. Normally two such connecting strands engage all of the elements. The connection can be formed by knotting the strand to each side of each element or by gluing, soldering, or welding the strand to each of the elements. Ends of the support element can be formed with slots in which the strand is wedged.

In a preferred embodiment the elements in accordance with the invention are formed with longitudinally generally aligned holes through which the strand passes. In this case each element is formed with at least two such holes, preferably three. The strand passing in an S-shape longitudinally through the holes. Thus as the strand is tensioned, this will naturally force the support elements longitudinally away from each other into a uniform longitudinal spacing.

To avoid tilting of each support element away from a direction parallel to the sheet transport direction when the strand is tensioned, it is preferred according to the invention to use at least two strands. They extend parallel to each other, and the support elements are fixed in the same way to them. In this case each support element will preferably extend perpendicular to the direction it moves in and parallel to the sheet feed direction.

Each element according to the invention is generally flat plate formed with a throughgoing aperture and with a projection extending through the aperture of an adjacent plate. Each projection is a punched-out tab and is immediately adjacent the respective aperture. In fact the aperture is formed by punching out the respective tab, making manufacture of the support plates a simple one-step stamping operation.

BRIEF DESCRIPTION OF THE DRAWING

The above and other objects, features, and advantages will become more readily apparent from the following description, reference being made to the accompanying drawing in which.

SPECIFIC DESCRIPTION

Figure 1C:
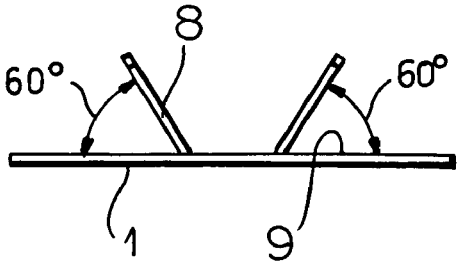
FIG. 1*c* is a side view of the element of FIG. 1*b;*
Figure 1B:
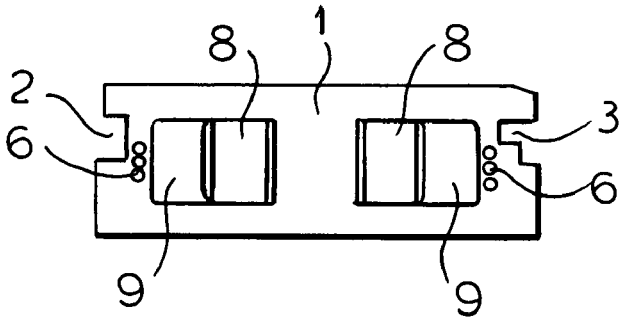
FIG. 1*b* is a top view of an individual support element in accordance with the invention.
Figure 1A:
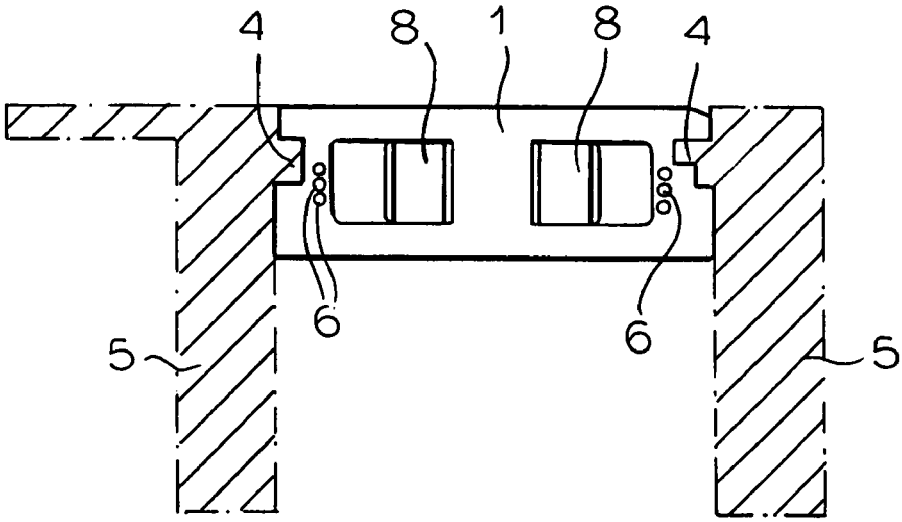
FIG. 1*a* is an end view of the system of this invention with guide rails.

As seen in FIG. 1*a*–1*c* a support element 1 is made of thin sheet metal. Each element 1 is formed with two transversely oppositely open apertures or grooves 2 and 3 by means of which the support elements 1 can be supported on and slid along longitudinal rails 4 to form the sheet support according to the invention. Guide bars 5 formed with the rails 4 extend at a right angle to the sheet plane in the longitudinal direction of the sheet support, relative to FIGS. 1*a*–1*c*, one of the elements 5 being at the downstream end of a sheet conveyor and the other of the elements 5 at the upstream end of a printing press.

Figure 4:
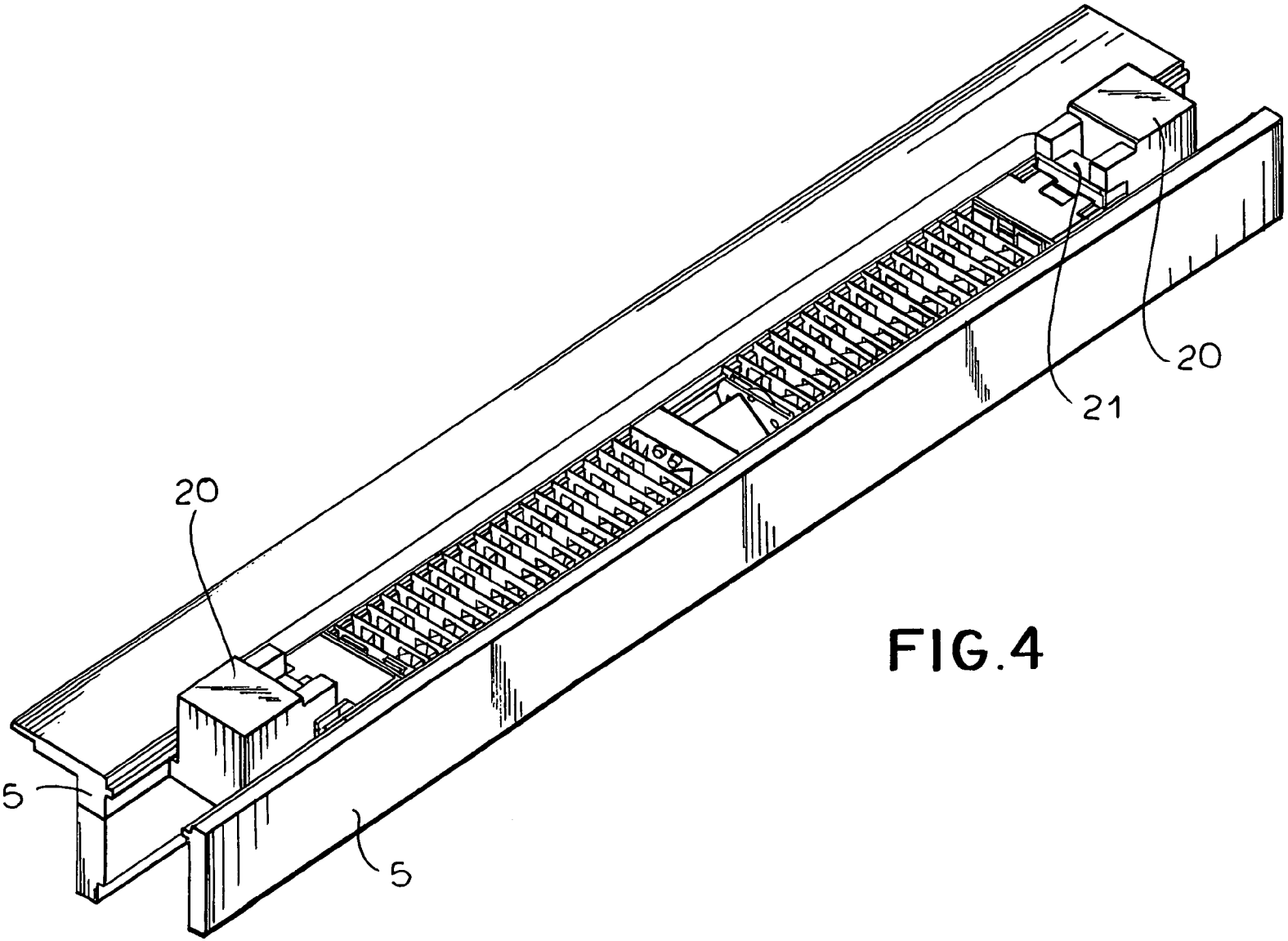
FIG. 4 is a perspective view of the sheet support in accordance with the invention.
Figure 5:
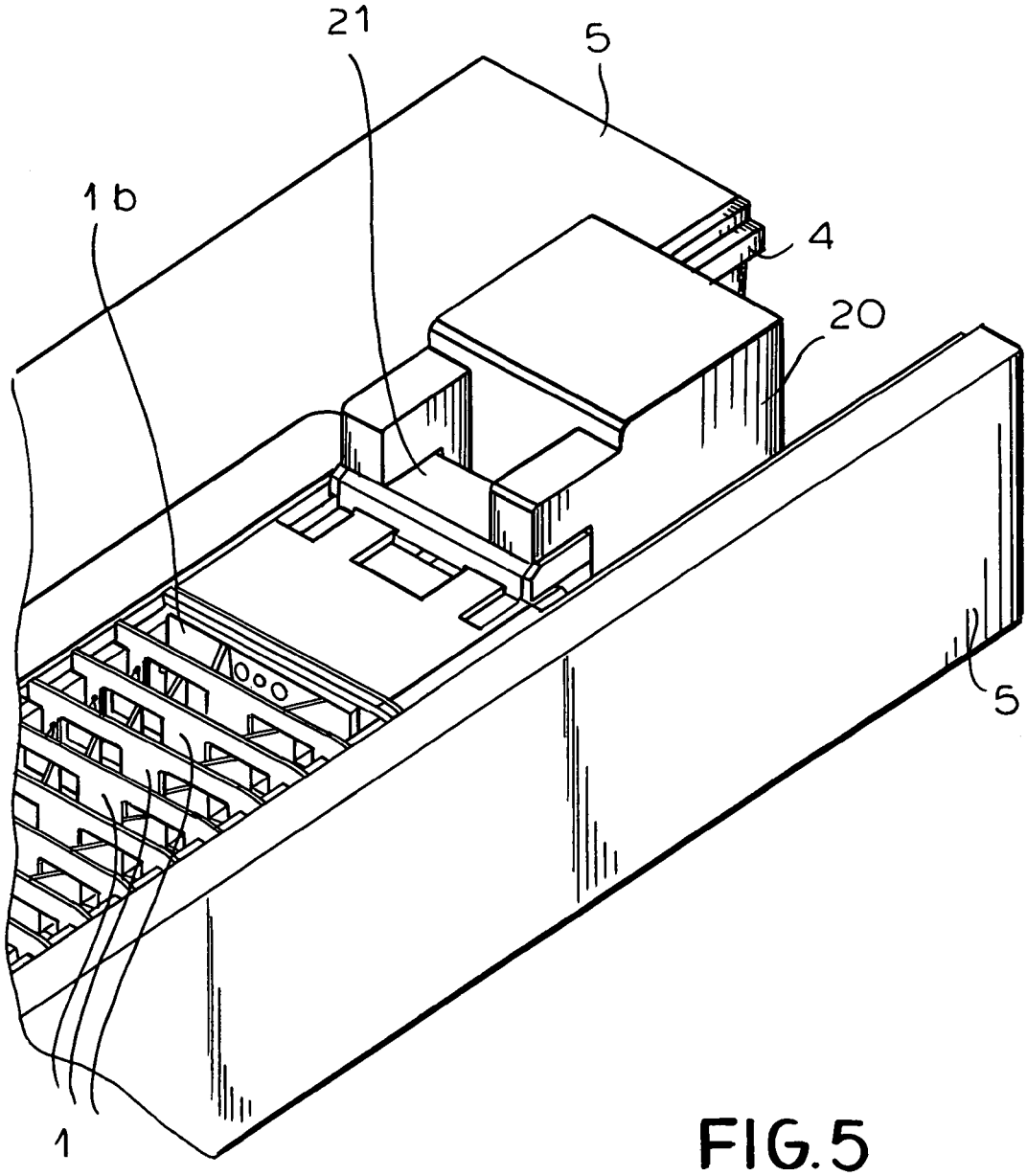
FIG. 5 is a detail view of an end portion of the structure shown in FIG. 4.

Immediately adjacent each of the grooves 2 and 3, three bores 6 are provided through which a connecting cable 7 (see FIGS. 2*a* and 2*b*) or strip serving as connecting element can pass, so that all the support elements 1 of the sheet support are lined up in a row on this band or cable. The support elements 1 can be securely fastened to the cable 7 e.g. by knotting the cable 7 in front of and behind each of the elements 1 or by fixing the cable 7 to the support element 1 at the bore 6 it passes through. As shown in FIGS. 4 and 4, the cables 7 are anchored at their ends in end blocks 21 held in mounts 20 fitted between the guide bars 5.

Here the cable 7 is threaded back and forth through the three bores 6 in a nonstraight path, for example, threaded through the bores 6 in an S-shaped or sinusoidal path for automatic stopping. For example, a cable 7 coming out of the upper bore 6 of a support element 1 can pass through the lower bore 6 of an adjacent support element 1, then back through the central bore 6 of the next support element 1, through the upper bore 6 of the next element 1, and so on. Following a path of this shape ensures that, when the cables 7 are stressed longitudinally, that is perpendicular to the planes of the elements 1, they will automatically space the elements 1 at a uniform longitudinal spacing parallel to one another. The bores 6 are formed near rail-shaped guides 5 to ensure a uniform exertion of force when the end blocks 21 pulled apart to tension the cables 7 and prevent the support element 1 from shifting diagonally in the guide, that is into skew positions.

FIGS. 1*a*–1*c* show how two tabs 8 are bent out of the surface of each support element 1 and each assume a preferred angle of 60° to the plane of the element 1. The tabs 8 can be produced by punching or cutting and subsequent bending and thereby forming adjacent each tab 8 an aperture 9 that accommodates a tab 8 of an adjacent support element 1. The fitting of the support elements 1 into one another with the individual tabs 8 can be seen especially clearly in FIGS. 2*a* and 2*b*.

Figure 2A:
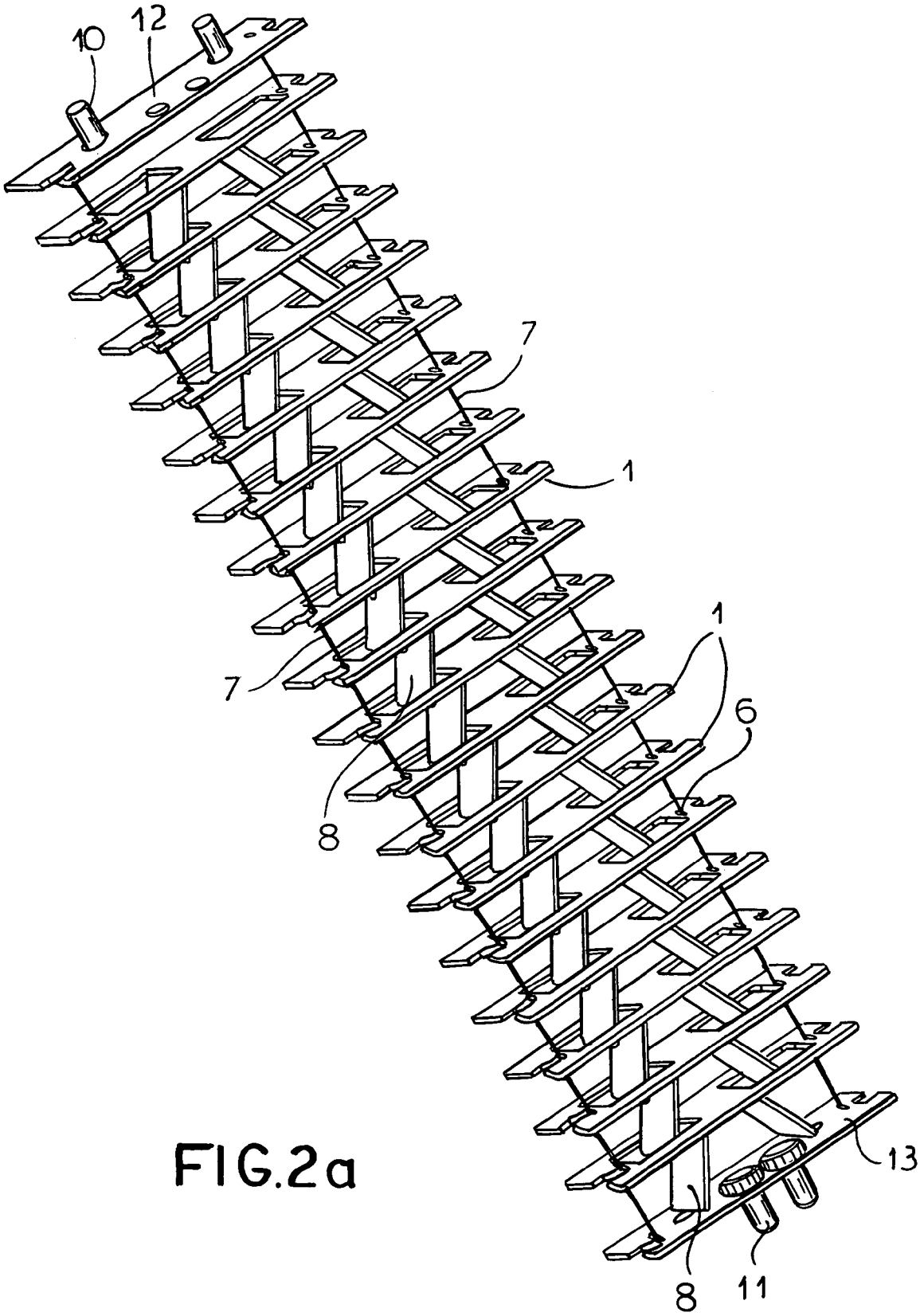
FIG. 2*a* is a perspective view of the sheet support at full expansion.
Figure 2B:
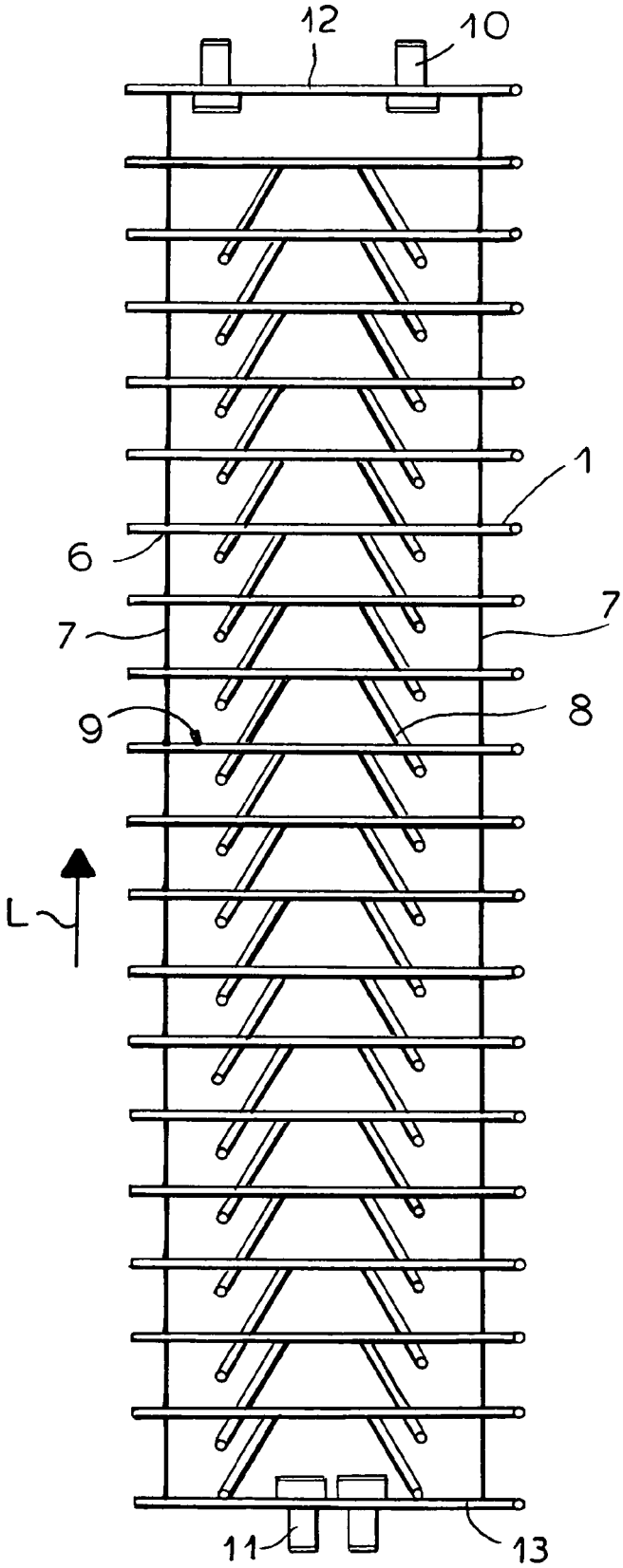
FIG. 2*b* is a top view of the structure of FIG. 2*a;*
Figure 2C:
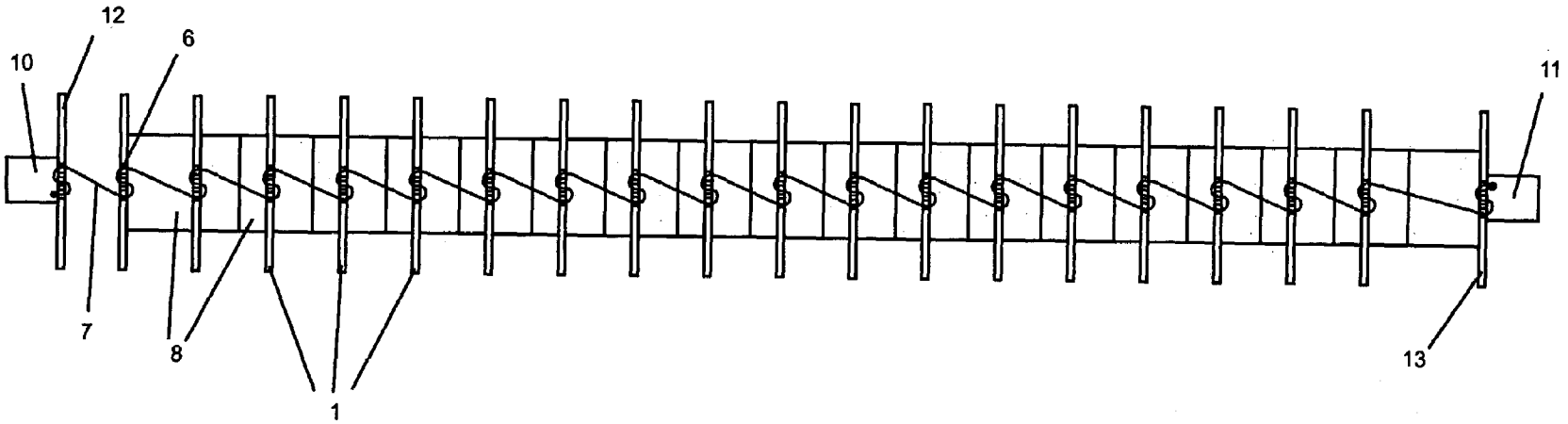
FIG. 2*c* is a side view of the structure with the strand passing sinusoidally longitudinally through the holes of the support structure.

FIGS. 2*a* and 2*b* show an overall view of a sheet support with several support elements 1 which are at a maximum possible distance from one another as determined by the length of the cable 7. The cable 7 to which each of the support elements 1 is fastened extends straight and longitudinally between the support elements 1 in the vicinity of the outer guide rails 5 (not shown in FIGS. 2*a* and 2*b*). In this case, the maximum distance is set such that the outer end of a tab 8 of a support element 1 engages in and in fact passes through the aperture 9 of an adjacent support element 1. As shown in FIG. 2*b*, this gives considerable stability and prevents sagging of all support elements 1 at a right angle to the plane of the sheet which is normally horizontal and parallel to the longitudinal direction L.

The support elements 12 and 13 at the ends have a different construction so that they can be fastened by screws 10 and 11 to end blocks 21 which can serve as a side stop for sheets, e.g. paper sheets. In this case, the screws or similar fastening elements 10 and 11 can be arranged such that the apertures 9 of the support elements 1 are above the screw heads 10 of the element 12 when pushed together and/or the heads of the screws 11 are arranged between the tabs 8 of the element 13.

Figure 3B:
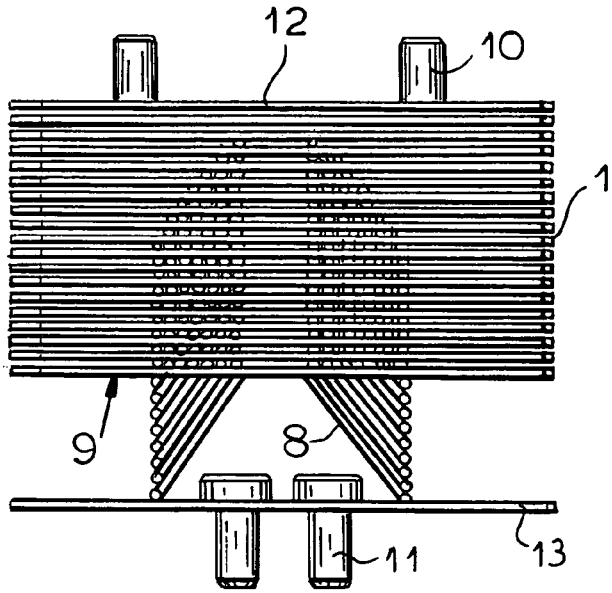
FIG. 3*b* is top view of the structure of FIG. 3*a;*
Figure 3A:
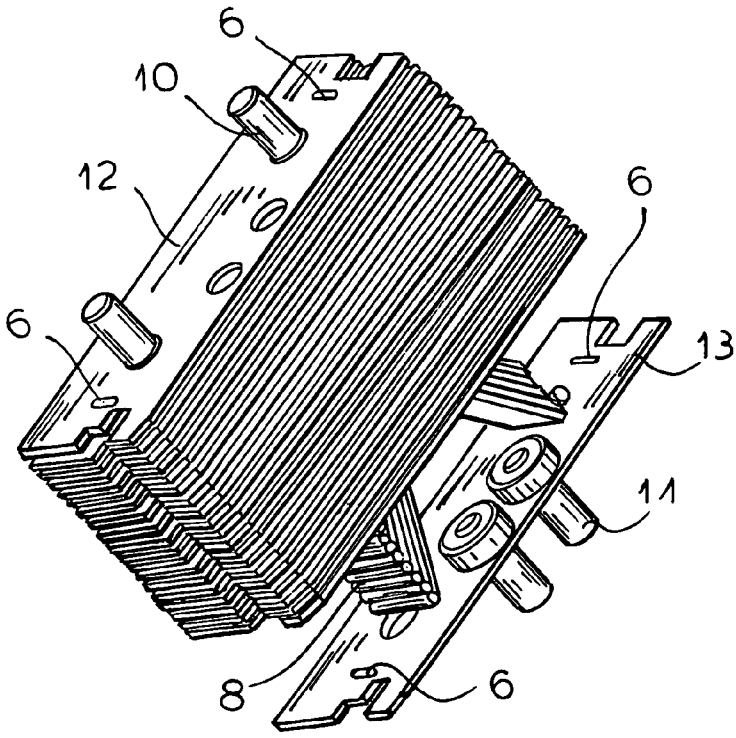
FIG. 3*a* is a perspective view of the sheet support at maximum compression.

FIGS. 3*a* and 3*b* show the individual support elements 1 in a completely pushed-together or longitudinally compressed state. The support elements 1 are pushed together and can even bear directly against one another. Loops of the cable 7 can be between adjacent elements 1 so that the compressed length of the row of a predetermined number of the elements 1 is roughly equal to the thickness of the elements multiplied by the predetermined number plus the cable diameter multiplied by this predetermined number. If the cable can slide in the holes 6 or is mounted on outer edges of the elements 1, the total stack length can be equal simply to the thickness of one of the elements multiplied by the predetermined number, in which case the elements 1 flatly engage one another in surface contact and the cable 7.

Compared to prior-art supports, the sheet support according to the invention has the advantage that the minimal gap width (aside from the end blocks) can essentially correspond to the sum of the thicknesses of all individual support elements 1.

I claim:

1. In combination with a pair of parallel longitudinally extending and transversely spaced guides, a sheet support comprising:

a stack of substantially identical and transversely extending support elements having transversely opposite ends slidable along the guides; and a flexible connecting strand engaging all of the elements such that when stressed longitudinally the elements separate longitudinally from one another at a generally uniform spacing.

2. The sheet support defined in claim 1 wherein the strand is secured at generally uniform spacings along its length to the elements.

3. The sheet support defined in claim 1 wherein two such connecting strands engage all of the elements.

4. The sheet support defined in claim 1 wherein the elements are formed with longitudinally generally aligned holes through which the strand passes.

5. The sheet support defined in claim 4 wherein each element is formed with at least two such holes, the strand passing sinusoidally longitudinally through the holes.

6. The sheet support defined in claim 1 wherein each element is generally flat plate.

7. The sheet support defined in claim 6 wherein each plate is formed with a throughgoing aperture and with a projection extending through the aperture of an adjacent plate.

8. The sheet support defined in claim 7 wherein each projection is a punched-out tab and is immediately adjacent the respective aperture.

9. The sheet support defined in claim 1, further comprising a pair of end supports flanking the stack and in which ends of the flexible strand are anchored.

10. In combination with a pair of parallel longitudinally extending and transversely spaced guides, a sheet support comprising:

a row of substantially identical and transversely extending support plates having transversely opposite ends slidable along the guides and each formed with two spaced holes; and a flexible connecting strand passing generally sinusoidally through one of the holes of each of the elements such that when stressed longitudinally the elements separate longitudinally from one another at a generally uniform spacing.

* * * * *